United States Patent [19]

Handren et al.

[11] 4,021,273

[45] May 3, 1977

[54] HYSTERESIS ALLOY

[75] Inventors: Ralph M. Handren, Crystal Lake, Ill.; John P. McKay, Walworth, Wis.

[73] Assignee: Arnold Engineering Company, Marengo, Ill.

[22] Filed: Oct. 1, 1975

[21] Appl. No.: 619,144

Related U.S. Application Data

[62] Division of Ser. No. 554,350, Feb. 28, 1975.

[52] U.S. Cl. ..... 148/121; 148/31.57; 75/124

[51] Int. Cl.[2] ..... H01F 1/00

[58] Field of Search ..... 148/121, 120, 31.55, 148/31.57, 3; 75/124

[56] References Cited

UNITED STATES PATENTS

| | | | |
|---|---|---|---|
| 1,818,054 | 8/1931 | Elmen | 148/31.57 |
| 1,968,569 | 7/1934 | Ruder | 148/31.57 |
| 2,207,685 | 7/1940 | Russell et al. | 148/31.57 |
| 2,797,161 | 6/1957 | Ireland et al. | 75/124 |

*Primary Examiner*—Walter R. Satterfield
*Attorney, Agent, or Firm*—Vincent G. Gioia; Robert F. Dropkin

[57] ABSTRACT

The invention relates to a novel alloy consisting essentially of 13–18% nickel, 7–11% aluminum, 0.5 to 10% cobalt, 0.1 to 2% silicon and the remainder substantially all iron, as is produced by heating the alloy composition to a temperature of about 1650° C or above to form a melt and then casting the melt in a suitable mold. After solidification, the casting is heated to approximately 1150° C, held at that temperature for a sufficient time to insure that the whole mass is heated uniformly, and then cooled at the rate of about 300° C per minute. Parts are then given an aging for the purpose of producing uniform magnetic properties throughout the casting. Magnets thus cast, heat-treated and aged as aforesaid produce very stable magnetic properties with typical values of Br = 10,000, Hc = 150 and BH max = .85.

A further improvement in properties can be achieved by a second stage heat treatment wherein castings are heated to about 900° C, held at this temperature for a sufficient time to assure that the whole mass is heated uniformly, and then cooled to about 600° C at the rate of 60° C per minute, followed by aging. Parts thus treated with the second stage heat treatment produce very stable magnetic properties with typical values of Br = 9,500, Hc = 230 and BH max = 1.2. These properties are extremely well suited to many hysteresis torque producing devices.

7 Claims, 16 Drawing Figures

HYSTERESIS ALLOY

This is a division, of application Ser. No. 554,350, filed Feb. 28, 1975.

BACKGROUND OF THE INVENTION

While not limited thereto, the present invention is particularly adapted for use in the production of parts for hysteresis torque producing devices. Such hysteresis torque producing devices ordinarily utilize a rotating magnetic field to drive a rotor through its hysteresis loop. Hysteresis devices are synchronous, providing the maximum torque is not exceeded. Beyond this point, the torque transmitted is independent of the slip speed, and remains essentially constant.

The rotor for hysteresis devices, also called a follower, inherently operates at small air gaps which result in thin-walled tubular magnets, precision ground internally and externally. These rotors are unique in their magnetic design requirements since the area of the hysteresis loop is the important parameter rather than the more familiar residual induction (BR) maximum energy product (BH max) or coercive force (Hc) although these latter parameters, taken together, do approximate the area of the loop. That is, the greater the parameters, the greater is the area encompassed by the loop. Furthermore, this hysteresis area is not that of the saturation hysteresis loop, but the one corresponding to the peak field developed by a stator winding or other permanent magnet. Finally, the whole thickness of the follower does not necessarily become magnetized to the same degree.

As a result, the magnetic properties of rotor materials for hysteresis devices are very specific; and since the correlation between magnetic properties and torque transmission is not linear, the allowable range of magnetic properties is limited.

Materials presently used for hysteresis devices can generally be classified as steels, Alnico alloys, and others. Alloy steels using cobalt have found the widest use in hysteresis devices. By convention, 3%, 17% and 36% cobalt steels are standard compositions for hysteresis devices and have provided a useful choice of magnetic properties. Cobalt steels also contain amounts of tungsten, manganese and chromium, but no nickel. High carbon steel and some chromium steels are also used. These materials are usually quenched-hardened in air, oil or water to develop coercive force and, consequently, hysteresis area. Quenching demands careful attention to detail and does not necessarily produce uniform magnetic properties. Furthermore, quenching physically distorts the shapes formed from these alloys; and because of the precision dimensions required, parts formed from steel or alloys of this type are machined to a definite size before heat treatment and precision ground to final size thereafter. This is an expensive procedure with a final part having a wide range of magnetic properties frequently demanding selective assembly into a hysteresis device.

Alnico II, V or VI is used in some hysteresis devices and can produce improved volumetric efficiency (i.e., larger area encompassed by the hysteresis curve). However, to do so requires a high input power with consequent heating which must be considered. This high input power requirement has limited the use of Alnico. Some investigators have proposed alloys for hysteresis devices based on small changes in Alnico chemistry coupled with a special heat treatment. Generally, these alloys have been impossible to control. That is, the first heat treatment yields a small number of parts with the desired magnetic properties; and repeated tries each yield the same small number of parts. The result has been very expensive magnets and a process that defies scheduling. Other materials used for hysteresis devices are Cunife, Cunico, Vicalloy and P-6 (Trademarks). P-6 is probably the most widely used and is described in U.S. Pat. No. 2,596,705. This alloy is similar to Vicalloy in that it utilizes large amounts of cobalt (40% or greater). However, it requires a severe crosssectional area reduction which produces a preferred orientation to the resulting wire or strip and a detail heat treatment. In general, it can be said that presently-used alloys are disadvantageous for the reason that they require large amounts of cobalt (i.e., 17–40% by weight), have magnetic properties which are difficult to control, result in yield of only 10–35%, and require cumbersome magnetic testing of parts since the total hysteresis area must be evaluated.

SUMMARY OF THE INVENTION

In accordance with the present invention, a new and improved alloy is provided for use in hysteresis devices and the like wherein yields are improved markedly over prior art alloys in that the magnetic properties can be duplicated (within a range of ±5%) each time the alloy is produced and heat treated in accordance with the teachings of the invention.

The alloy of the invention is precipitation-hardened which gives it two attributes. First, once established, the magnetic properties are very stable and not subject to long-term deterioration from relaxation of its lattice structure. Secondly, the alloy is very hard, having a hardness of Rockwell C 46 and, therefore, must be ground to finished dimensions. On the other hand, grinding trials show that the alloy is not brittle and metal removal rates are equivalent to hardened steel.

Further, in accordance with the invention, a new and improved heat treatment for the alloy of the invention is provided which improves its magnetic characteristics. The heat treatment may be a one-stage treatment or a two stage treatment, in which case the magnetic properties of the alloy are further enhanced. A typical BH max is 0.85 MGO with the one-stage heat treatment. With the two-stage treatment a typical value is 1.2 MGO. A BH max of at least 0.85 MGO is typical of the invention.

Specifically, the alloy of the invention consists essentially of about 13–18% nickel, 7–11% aluminum, 0.5 to 10% cobalt, 0.1 to 2% silicon, and the balance substantially all iron. In producing the alloy of the invention, the alloy composition is heated to a temperature of about 1650° C or above to form a melt which is thereafter cast into a suitable shape, usually the shape of a cylinder in the case of a hysteresis device. After solidification, the casting is elevated in temperature and then cooled at a specified rate followed by aging. Alternatively, before the aging treatment, a second-stage heat treatment can be performed wherein the castings are again heated to a specified temperature and then reduced in temperature at a specified rate followed by aging. Additions of silicon are preferred in all cases; and cobalt is an essential element in the alloy composition if the second-stage heat treatment is to be utilized.

The above and other objects and features of the invention will become apparent from the following detailed description taken in connection with the accompanying drawings which form a part of this specification, and in which.

DESCRIPTION OF THE PREFERRED EMBODIMENT

The broad and preferred ranges of composition of the alloy of the invention are as follows:

| Broad | Preferred |
|---|---|
| Nickel 13–18% | 16.5% |
| Aluminum 7–11% | 9% |
| Cobalt 0.5–10% | 8% |
| Silicon 0.1–2% | 0.5% |
| Iron - Balance | Balance |

While some of the desirable characteristics of the invention can be achieved without any additions whatever of cobalt and silicon, it is preferable to add at least that amount of cobalt and silicon effective to enhance the properties of the alloy as will hereinafter be explained.

The alloy is made by first melting the nickel, cobalt and iron with sufficient power in an induction furnace in air. When the last pieces charged into the furnace are melting, Fe Si is added, followed by aluminum. At a temperature (immersion) of 1670°–1690° C, the alloy is cast into molds to attain the desired shapes.

The shapes formed from the alloy are then heat treated in a single-stage or double-stage heat treatment. The initial heat treatment comprises heating the casting to approximately 1150° C where it is held at that temperature for a sufficient time to assure the whole mass is heated uniformly. Thereafter, it is cooled at a rate of about 300° C per minute to achieve optimum properties. The parts are then given an aging, typically at 665° C for 5 hours then, cooled at 14° C per hour to 550° C and held at 550° C for 5 hours minimum.

Figure 1:
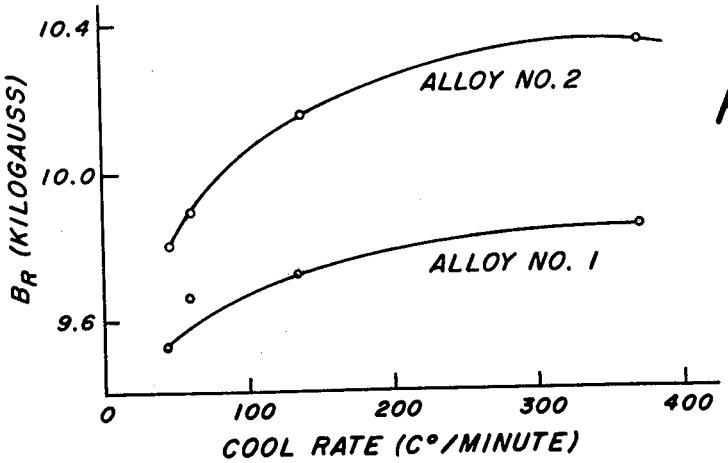
FIG. 1 is a plot of residual induction versus cooling rate from a temperature of 1150° C for two alloys of the invention, one of which contains silicon and the other of which does not.
Figure 2:
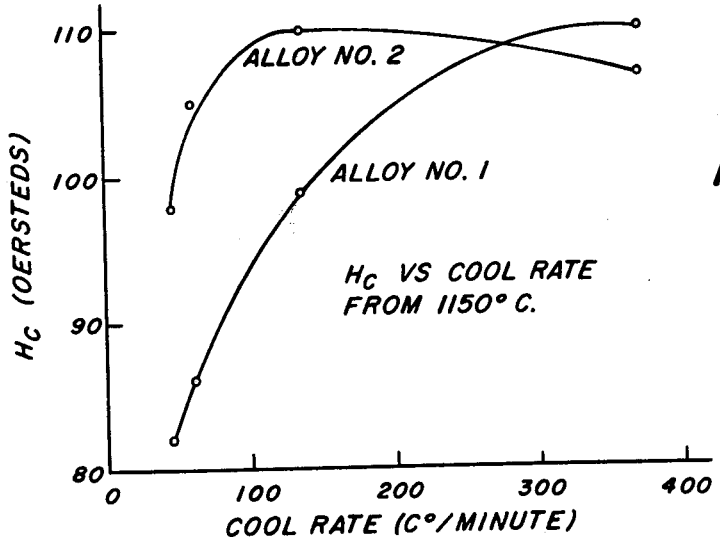
FIG. 2 is a plot of coercive force versus cooling rate from a temperature of 1150° C for the aforesaid two alloys.
Figure 3:
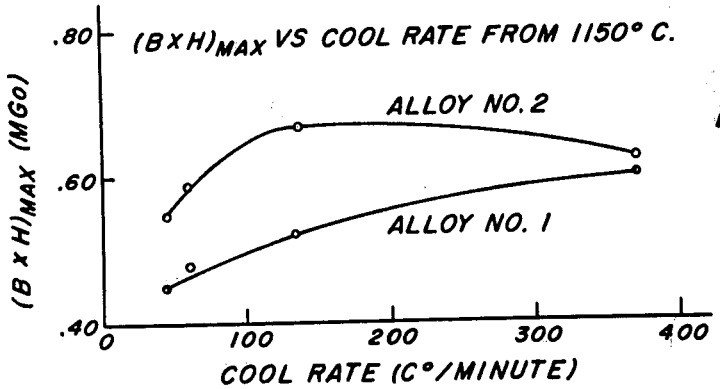
FIG. 3 is a plot of maximum energy product versus cooling rate from a temperature of 1150° C for the alloys illustrated in FIGS. 1 and 2.

The effect of the cooling rate with a single-stage heat treatment is shown in FIGS. 1–3. Results are shown for two alloys identified as Alloy No. 1 and Alloy No. 2 which have the following compositions:

| | Alloy No. 1 | Alloy No. 2 |
|---|---|---|
| Nickel | 16.5% | 16.5% |
| Aluminum | 9% | 9% |
| Silicon | — | 0.5% |
| Iron | 74.5% | 74% |

Both alloys are cooled from 1150° C and after the heat treatment were aged at 650° C for four hours and furnace-cooled at approximately 200° C per hour. It will be noted from FIGS. 1–3 that Alloy No. 2 containing 0.5% silicon exhibits a worthwhile improvement over Alloy No. 1 within a wide range of cooling rates from 200°–400° C per minute to allow for size variations when in production. In both cases, the cooling rate is maximized at about 300° C per minute, or at least in the range of 250° to 350° C. The residual induction (Br) actually increases at a cooling rate above 300° C per minute; and this same improvement is effected above 300° C per minute for Alloy No. 1 in the case of coercive force (Hc), but not for Alloy No. 2. The same is true of maximum energy product (BH max). Thus, experimental results indicate that a cooling rate of 300° C per minute from 1150° C is optimum for the first-stage heat treatment.

Figure 4:
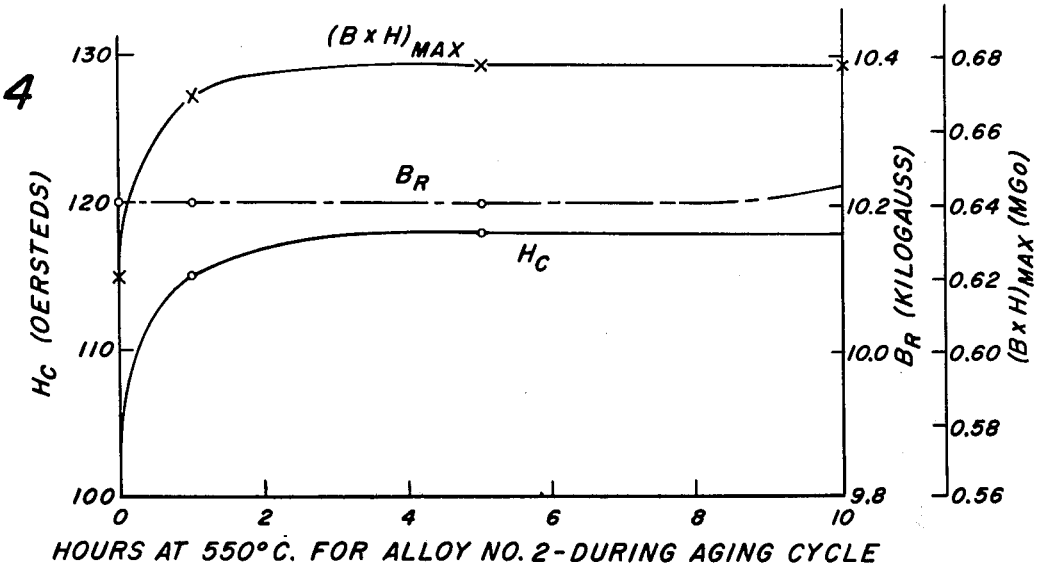
FIG. 4 is a plot of residual induction, coercive force and maximum energy product versus hours at 550° C during the aging cycle for an alloy of the invention containing silicon.

The effect of time during the aging cycle of Alloy No. 2 is shown in FIG. 4. In this case, the alloy was initially heated to 665° C and held at that temperature for 5 hours, followed by cooling at 14° C per hour to 550° C. It will be noted that all magnetic characteristics with the possible exception of residual induction are maximized when the alloy is held at 550° C for a period of 5 hours. Residual induction (Br) does increase slightly, above 8 hours. In any event, the preferred range is 5–10 hours at 550° C before removal from the furnace. Holding the same alloy at 760° C for 2 hours or at 665° C for 1 hour, for example, produced inferior results.

Figure 5:
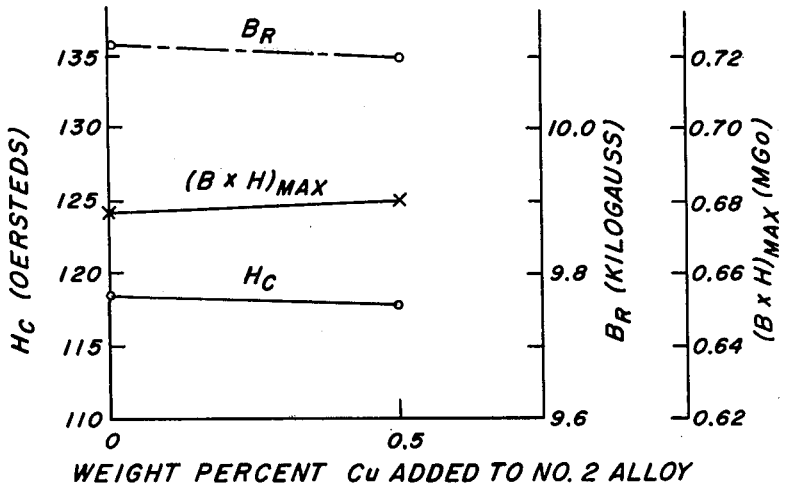
FIG. 5 is a plot showing the effect of copper additions to Alloy No. 2.
Figure 6:
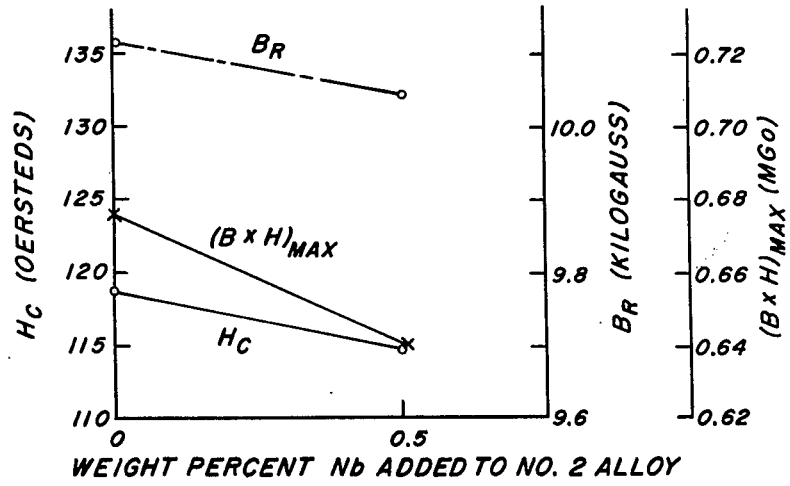
FIG. 6 is a plot showing the effect of niobium additions to Alloy No. 2.

The results of additions of copper and niobium are shown in FIGS. 5 and 6. FIG. 5, illustrating the effect of copper additions, shows practically no change in magnetic properties when heat treated by heating to 1150° C for 20 minutes, cooling in air at 390° C per minute and then aging with the optimized aging treatment described above wherein the alloy is heated to 665° C and held at that temperature for 5 hours, cooled at 14° C per hour to 550° C, and then held at this temperature for 10 hours before removal. Thus, in contrast to most Alnico alloys, copper additions, while not deleterious, do not improve magnetic properties either.

FIG. 6 shows the effect of additions of niobium to Alloy No. 2. It will be noted that niobium materially decreases the magnetic properties when heat treated and aged in a manner identical to the alloy of FIG. 5 as well as Alloys No. 1 and No. 2.

Figure 7:
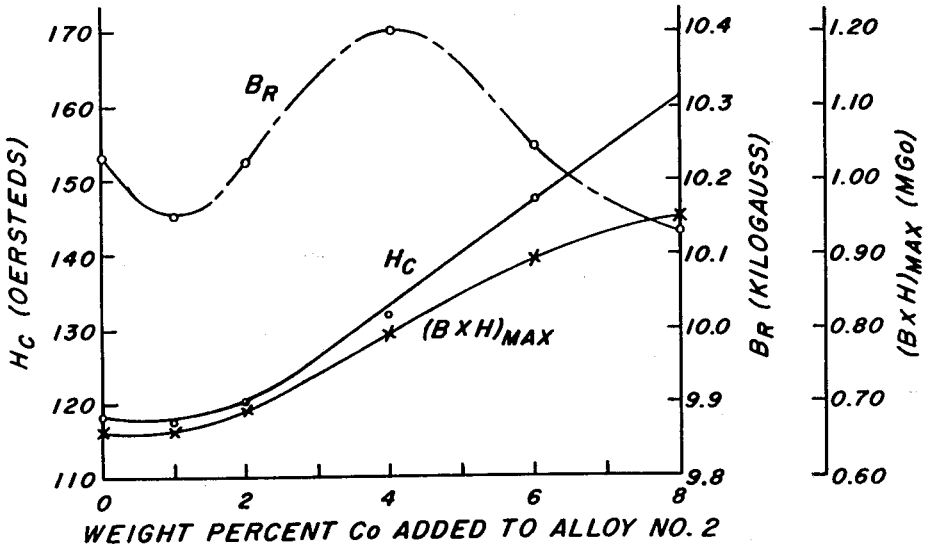
FIG. 7 is a plot showing the effect of cobalt additions to the alloy of the invention for the case where a single-stage heat treatment is employed.
Figure 8:
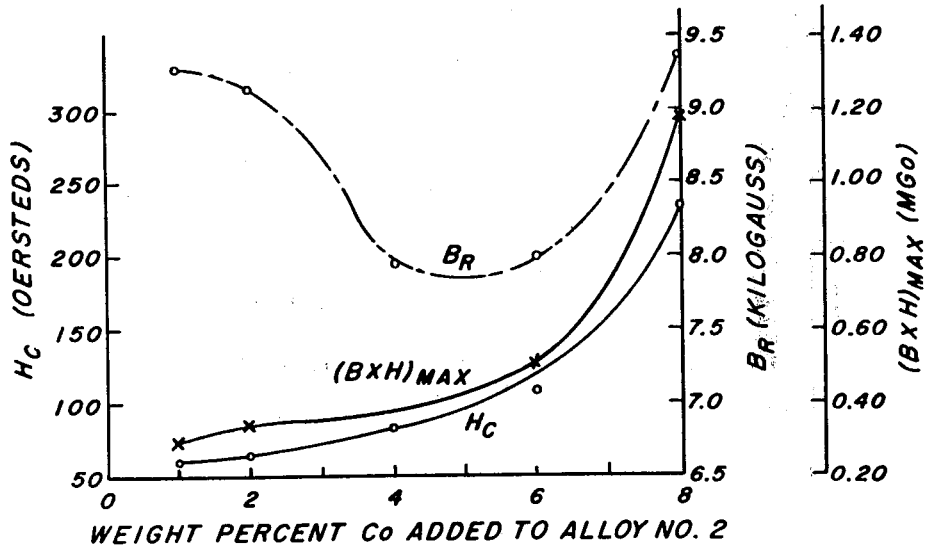
FIG. 8 is a plot showing the effect of cobalt additions to the alloy of the invention for the case where a two-stage heat treatment is employed.

The effect of cobalt additions to the aforesaid Alloy No. 2 is illustrated in FIGS. 7 and 8. In FIG. 7, the preferred single-stage heat treatment of the invention is used followed by aging; whereas in FIG. 8, the preferred two-stage heat treatment is utilized with aging.

Additions were made to Alloy No. 2 at the expense of iron, the resulting alloy being designated as follows:

1% Cobalt — Alloy No. 8
2% Cobalt — Alloy No. 9
4% Cobalt — Alloy No. 11
6% Cobalt — Alloy No. 14
8% Cobalt — Alloy No. 12

As can be seen from FIGS. 7 and 8, magnetic properties are maximized for both a single-stage as well as a two-stage heat treatment with a cobalt addition of 8%; however even minor additions of cobalt above 0.5% improves properties. Cobalt additions beyond 8% were not made since the magnetic properties attained at 8% meet the principal demands of commercial, salable magnetic alloys of this type; although additions up to 10% can be made as explained above.

Figure 9:
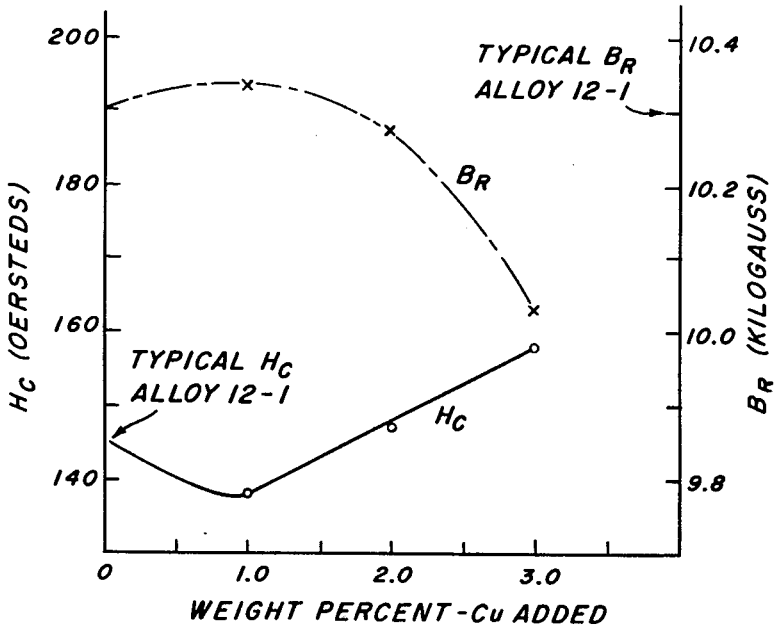
FIGS. 9 and 10 are plots illustrating the deleterious effects of copper additions to the alloy of the invention.
Figure 10:
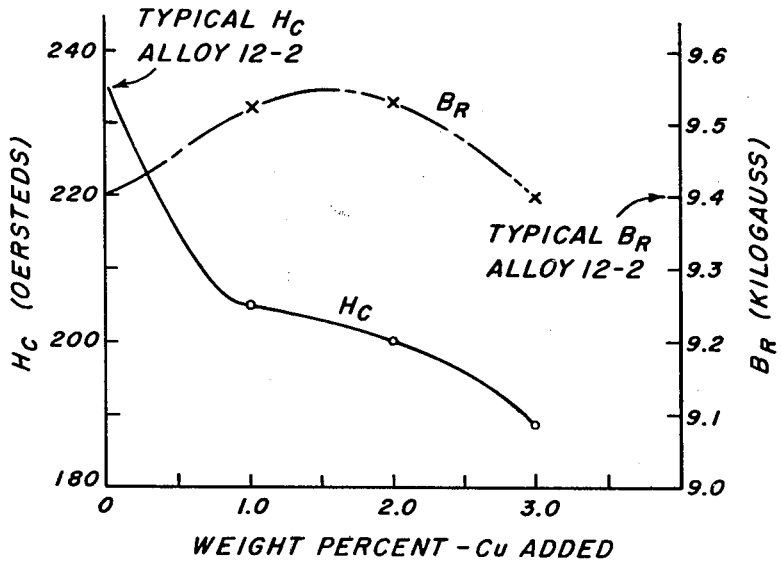

Thus, Alloy No. 12 with an 8% cobalt addition has optimum magnetic properties. FIGS. 9 and 10 show the effect of copper additions to Alloy No. 12 for the case where a single-stage and double-stage heat treatment are employed prior to aging, respectively. In FIG. 9 where only a single-stage heat treatment is employed, coercive force decreases up to 1% copper and then increases; however residual induction decreases gradually as copper is added up to 3%. In the case of FIG. 10 where a double-stage heat treatment is employed, both residual induction and coercive force decrease as copper is increased; although residual induction does increase slightly up to 1.5% copper. This shows, of course, that copper additions should be avoided, particularly at the higher cobalt levels. No benefit whatever is derived in the double-heat treatment (FIG. 10); and in the case of the single heat treatment (FIG. 9), the loss of Br to achieve improved Hc is too great to be acceptable.

Alloy No. 8 (1% cobalt), Alloy No. 11 (4% cobalt) and Alloy No. 12 (8% cobalt) were selected for a study of the second heat treatment temperature and cool rates. These are tabulated below and plotted in FIGS. 11–16.

| Heat Treat Temp. | Cool Rate No. 1 | Cool Rate No. 2 | Cool Rate No. 3 |
|---|---|---|---|
| 980° C | 390° C/min. | 77° C/min. | 43° C/min. |
| 940° C | 345° C/min. | 70° C/min. | 39° C/min. |
| 900° C | 300° C/min. | 60° C/min. | 33° C/min. |
| 860° C | 270° C/min. | 54° C/min. | 30° C/min. |

Figure 11:
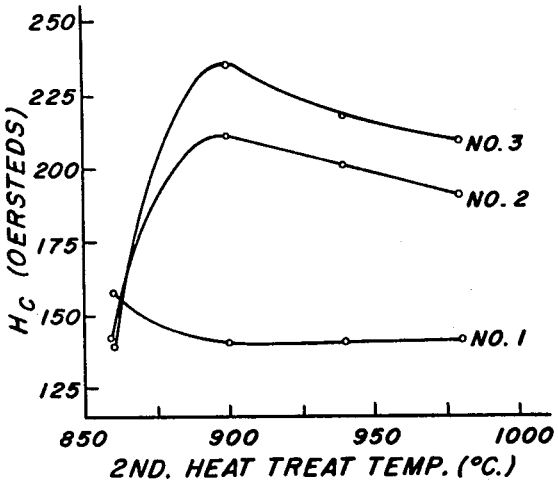
FIGS. 11–16 are plots illustrating the effect of cobalt additions to the alloy of the invention after undergoing a two-stage heat treatment.
Figure 12:
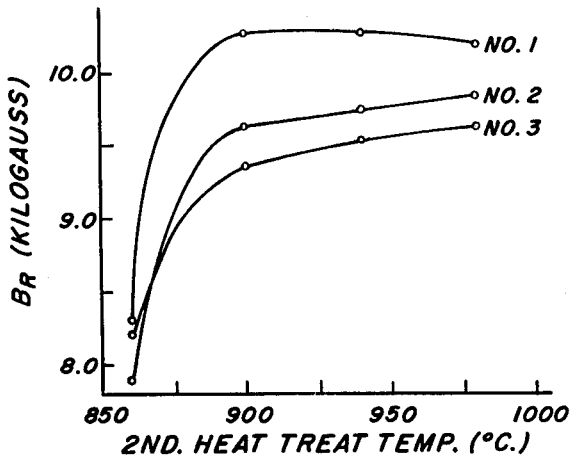

The results for Alloy No. 12 containing 8% cobalt are shown in FIGS. 11 and 12. Note that optimum properties are achieved when the heat treatment temperature reaches about 900° C, above which they actually decrease in the case of coercive force. The cooling rate has an opposite effect on coercive force and residual induction; and for this reason cooling rate No. 2 (i.e., 60° C per minute) is preferred.

Figure 13:
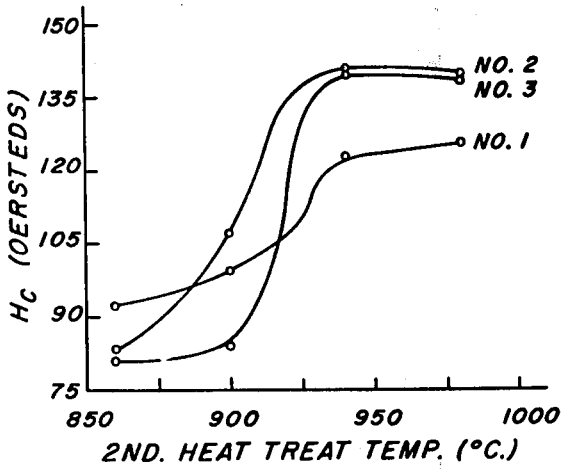
Figure 14:
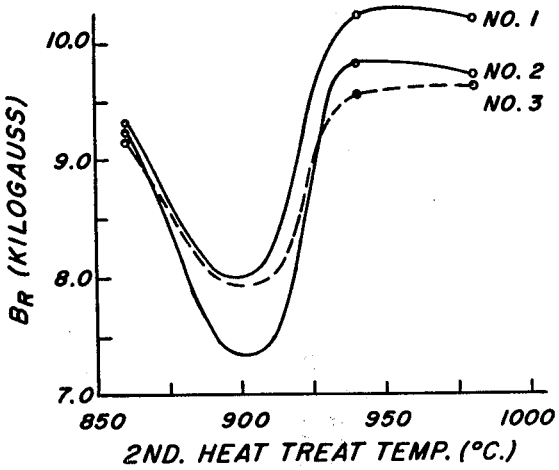

The effect of lowering cobalt additions is shown in FIGS. 13–16. In FIGS. 13 and 14, Alloy No. 11 utilizing only 4% cobalt is shown; and it will be noted that in order to obtain maximized magnetic properties, the heat treatment temperature must be above 900° C, and preferably 950° C. Furthermore, coercive force values are much lower than in the case of Alloy No. 12 containing 8% cobalt (FIG. 11) although residual induction characteristics are similar for Alloy No. 11 containing 4% cobalt as Alloy No. 12 containing 8% cobalt, assuming that the heat treatment temperature of 950° C is employed. Here, again, taking all things into consideration, cooling rate No. 2 is preferred since, as the cooling rate decreases, coercive force characteristics increase while residual induction characteristics decrease.

Figure 15:
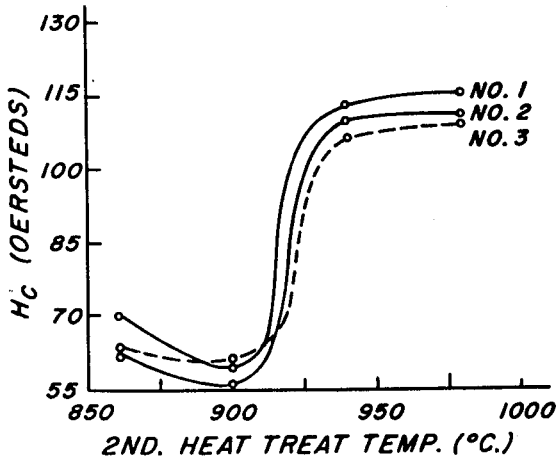
Figure 16:
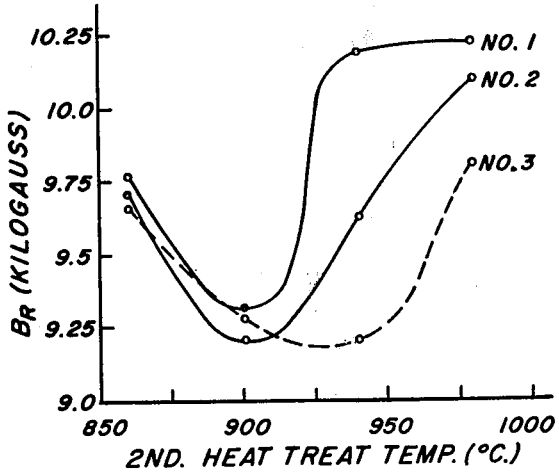

Finally, in FIGS. 15 and 16 results are shown for Alloy No. 8 containing only 1% cobalt. Here coercive force is materially lower and again a heat treatment temperature of 950° C is required to achieve any worthwhile results.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A method for producing a magnetic alloy having stable magnetic properties consisting essentially of about 14 to 17% nickel, 7 to 11% aluminum, 0.5 to 10% cobalt, 0.1 to 2.0% silicon and the balance substantially all iron comprising the steps of:

A. heating the aforesaid components to a temperature of at least 1650° C to form a melt,
B. casting the melt in a suitable mold and permitting the casting to solidify,
C. heating the casting for a sufficient time to insure that the whole mass is substantially uniformly heated;
D. cooling the casting, and
E. aging the casting to produce a Rockwell hardness on the order of about C46 and substantially uniform magnetic properties throughout with a maximum energy product (BH max.) of at least 0.85 MGO.

2. The method of claim 1, wherein the aging step comprises: (E1) heating the casting at about 665° C for five hours, (E2) then cooling it at 14° per hour to 550° C, and (E3) holding the casting at 550° C for 5 hours minimum, thereby maximizing the magnetic characteristics.

3. The method of claim 2, wherein in step (E3), the casting is held at 550° C for a period of 5 to 10 hours.

4. The method of claim 1, wherein the aging step comprises: (E5) heating the casting at 650° C for four hours, and (E6) furnace-cooling the casting at approximately 200° C per hour.

5. The method of claim 1, including (F) an additional heat treatment performed after the step (D) cooling and prior to step (E) aging comprising: (F1) heating the cooled casting to a temperature of 900° C and holding the casting at the temperature of 900° C to assure that the whole mass is uniformly heated, and (F2) cooling the casting to about 600° C at the rate of 60° C from the aforesaid 900° C temperature, thereby producing a casting having uniform magnetic properties throughout with a maximum energy product of 1.2 MGO.

6. The method of claim 5 wherein aging comprises heating the casting at about 665° C for 5 hours, then cooling it at 14° C per hour to 550° C and holding it at 550° C for 5 hours minimum.

7. The method of claim 6, wherein the casting is held at 550° C for a period of 5 to 10 hours and then air cooled.

* * * * *